US007690079B2

(12) United States Patent
Boddy et al.

(10) Patent No.: US 7,690,079 B2
(45) Date of Patent: Apr. 6, 2010

(54) HEAD FOR A SUCTION CLEANER

(75) Inventors: Andrew David Boddy, Worcester (GB); Christopher Thomas Elsworthy, Cheltenham (GB); Gavin Burnham, Birmingham (GB); Reuben Proud, Worcester (GB); Bengt Ivar Anders Ivarsson, Ma Wan (HK)

(73) Assignee: VAX Limited, Droitwich (GB)

( * ) Notice: Subject to any disclaimer, the term of this patent is extended or adjusted under 35 U.S.C. 154(b) by 346 days.

(21) Appl. No.: 10/537,382

(22) PCT Filed: Dec. 5, 2003

(86) PCT No.: PCT/GB03/05301

§ 371 (c)(1),
(2), (4) Date: Nov. 14, 2005

(87) PCT Pub. No.: WO2004/052166

PCT Pub. Date: Jun. 24, 2004

(65) Prior Publication Data

US 2006/0179604 A1 Aug. 17, 2006

(30) Foreign Application Priority Data

Dec. 6, 2002 (GB) ..... 0228478.4
Dec. 6, 2002 (GB) ..... 0228481.8

(51) Int. Cl.
*A47L 9/02* (2006.01)
*A47L 5/10* (2006.01)
*A47L 5/26* (2006.01)
*A47L 5/00* (2006.01)

(52) U.S. Cl. ..... 15/389; 15/415.1; 15/383; 15/390; 15/319

(58) Field of Classification Search ..... 15/415.1, 15/387, 389–391; 474/139
See application file for complete search history.

(56) References Cited

U.S. PATENT DOCUMENTS

| | | | | | |
|---|---|---|---|---|---|
| 1,829,582 | A | * | 10/1931 | Carson | 15/347 |
| 1,833,961 | A | * | 12/1931 | Bass | 15/344 |
| 1,900,889 | A | * | 3/1933 | Becker | 15/384 |
| 1,968,530 | A | * | 7/1934 | Leathers | 15/389 |
| 2,482,166 | A | * | 9/1949 | Gage | 55/297 |
| 2,910,721 | A | * | 11/1959 | Burrage | 15/342 |
| 2,963,270 | A | * | 12/1960 | Magarian | 415/147 |
| 3,482,276 | A | * | 12/1969 | Fillery | 15/349 |
| 3,924,085 | A | * | 12/1975 | Stone | 200/61.62 |
| 4,980,945 | A | * | 1/1991 | Bewley | 15/339 |
| 5,078,761 | A | | 1/1992 | Dyson | |
| 5,125,127 | A | | 6/1992 | Bach et al. | |
| 5,135,552 | A | | 8/1992 | Weistra | |

(Continued)

FOREIGN PATENT DOCUMENTS

DE 38 34 686 C1 12/1989

(Continued)

OTHER PUBLICATIONS

Pending U.S. Appl. No. 11/187,414, filed Jul. 22, 2005, 23 pages.

(Continued)

*Primary Examiner*—Bryan R Muller
(74) *Attorney, Agent, or Firm*—Michael Best & Friedrich LLP

(57) ABSTRACT

A head (10) for a suction cleaner is described. The head (10) including: a lower housing portion (12); an upper housing portion (14); and a rotatably mounted brush bar (26) mounted within the housing portions (12, 14). The upper housing portion (14) is pivotable relative to the lower housing portion (12) between a closed position for use and an open position in which the brush bar (26) is exposed from above and the front.

24 Claims, 14 Drawing Sheets

U.S. PATENT DOCUMENTS

| | | | | | |
|---|---|---|---|---|---|
| 5,351,362 | A * | 10/1994 | Kramer et al. | ..... | 15/387 |
| 5,414,893 | A * | 5/1995 | Hampton et al. | ..... | 15/412 |
| 5,500,979 | A | 3/1996 | Wörwag | | |
| 5,659,919 | A * | 8/1997 | Kajihara | ..... | 15/325 |
| 5,960,514 | A | 10/1999 | Miller et al. | | |
| 6,058,559 | A | 5/2000 | Yoshimi et al. | | |
| 6,226,832 | B1 * | 5/2001 | McCormick | ..... | 15/391 |
| 6,350,292 | B1 | 2/2002 | Lee et al. | | |
| 6,513,190 | B1 * | 2/2003 | Allgeier et al. | ..... | 15/387 |
| 6,572,668 | B1 | 6/2003 | An et al. | | |
| 6,662,403 | B2 | 12/2003 | Oh | | |
| 2001/0008036 | A1 * | 7/2001 | Worwag | ..... | 15/387 |
| 2002/0011053 | A1 | 1/2002 | Oh | | |
| 2002/0062632 | A1 | 5/2002 | Oh | | |
| 2002/0088078 | A1 | 7/2002 | Oh et al. | | |
| 2002/0104185 | A1 * | 8/2002 | Weber et al. | ..... | 15/383 |
| 2002/0120998 | A1 | 9/2002 | Dubos et al. | | |
| 2002/0124538 | A1 | 9/2002 | Oh et al. | | |
| 2003/0106182 | A1 | 6/2003 | Lee | | |
| 2003/0106183 | A1 | 6/2003 | Frederick et al. | | |

FOREIGN PATENT DOCUMENTS

| | | | |
|---|---|---|---|
| DE | 94 20 797.6 | U1 | 7/1995 |
| DE | 4411526 | A1 | 10/1995 |
| DE | 19852750 | A1 | 5/2000 |
| DE | 299 00 460 | U1 | 8/2000 |
| DE | 199 14 574 | C1 | 11/2000 |
| DE | 10051177 | A1 | 10/2001 |
| DE | 10110770 | A1 | 3/2002 |
| DE | 101 10 771 | A1 | 9/2002 |
| EP | 1 160 737 | A1 | 12/2001 |
| EP | 1 386 573 | A2 | 2/2004 |
| FR | 2 425 227 | | 12/1979 |
| GB | 2 128 075 | A | 4/1984 |
| GB | 2 367 510 | A | 4/2002 |
| JP | 2000037327 | A2 | 2/2000 |
| RU | 2302809 | C2 | 1/2006 |
| WO | WO 98/35602 | A1 | 8/1998 |
| WO | WO 2004/049887 | A1 | 6/2004 |
| WO | WO 2004/049889 | A1 | 6/2004 |
| WO | WO 2004/049890 | A1 | 6/2004 |

OTHER PUBLICATIONS

Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 10, 2005, 21 pages.
Pending U.S. Appl. No. 10/537,381, filed Nov. 14, 2005, 25 pages.
Pending U.S. Appl. No. 10/537,481, filed Nov. 14, 2005, 14 pages.
Pending U.S. Appl. No. 11/273,094, filed Nov. 14, 2005, 17 pages.
Pending U.S. Appl. No. 11/329,194, filed Jan. 10, 2006, 23 pages.
Pending U.S. Appl. No. 11/375,722, filed Mar. 15, 2006, 16 pages.
Australian Examination Report for related application No. 2003288429 dated Jan. 11, 2007.
Indian Examination Report for related application No. 2638/DELNP/2005 dated May 11, 2007.
Russian Examination Report letters for related application No. 2005120732/12, various dates, English translation regarding same.

* cited by examiner

HEAD FOR A SUCTION CLEANER

DESCRIPTION OF INVENTION

The invention relates to a head for a suction cleaner, and in particular to a head including a rotatably driven tool element such as a brush bar, either of the kind adapted for attachment to a wand of a "cylinder" type suction cleaner, or of the kind incorporated in an "upright" type suction cleaner.

Domestic suction cleaners, more commonly called vacuum cleaners, are generally divided into two kinds; "upright" cleaners in which the head is integral with or at least pivotably connected to the main body of the cleaner, and "cylinder" cleaners in which a hose and/or wand connects any tools such as the head to the main body of the cleaner. In the former kind of cleaner the head usually includes a driven brush bar. In the latter kind all tools originally incorporated fixed brushes, but more recently various head designs have been introduced incorporating rotatably driven brushes.

The means of driving such brushes vary. In general in upright cleaners the brush bar is driven by a belt powered by electric motor, this being either the main motor which provides the suction or a secondary motor provided specifically for that purpose. In cylinder cleaners, some use the suction of the main vacuum cleaner and a turbine in the head to drive the brush, whilst others include an electric motor in the head powered by an electrical supply provided down the hose/wand combination. In the latter case the drive to the brush in the head may be by means of a belt or direct.

The problem with driven brushes, in both upright and cylinder vacuum cleaners, is that they often get entangled with elongate items which have been vacuumed up, such as pieces of string or ribbon, or even long human hair. This can result in significantly degraded performance because of restricted airflow around the brush and therefore it is important to remove such entangled items in order to obtain good performance from the vacuum cleaner. However, experience has shown that most users simply do not clear the brush bar as to do so in the prior art cleaners require the use of tools, generally to remove a sole plate of the head.

A problem which is common to all heads for suction cleaners, both with and without brush bars, is that of the airflow passages within the heads becoming fully or partially blocked by inappropriate debris which has been sucked up. Clearly in such circumstances the performance of the cleaner is severely degraded and can only be restored by clearance of the blockage. However, it has been found that with prior art suction cleaners users are very slow both to realise that a blockage has occurred and also to take the necessary action to clear it. The latter is largely because of the need to use to tools to open the head of the suction cleaner and because the task, even with tools, tends to be quite difficult to perform requiring a high degree of dexterity, as it can include removing and reinserting screws.

It is an object of the present invention to provide an improved form of cleaning tool employing a rotatably driven brush which mitigates the above described problems.

According to a first aspect of the present invention there is provided a head for a suction cleaner, the head including:

a lower housing portion; and an upper housing portion;

characterised in that the upper housing portion is movable, e.g. pivotable, relative to the lower housing portion between a closed position for use and an open position in which airflow passages within the head are opened from above.

The head of the invention provides the advantage that it can readily be opened for simple clearing of the airflow passages and general maintenance purposes.

The head may further include a rotatably mounted tool element such as a brush bar mounted within the housing portions.

Preferably the lower housing portion does not include any part which extends laterally in front of the brush bar, such that when the upper housing portion is in the open position the brush bar is also exposed from the front.

Furthermore it is preferable that the head does not include a sole plate, or the like.

Conveniently, when the upper housing portion is in the closed position it defines, in combination with the lower housing portion, an airflow opening which in use is adjacent the ground and within which the brush bar is located if included in the head.

Preferably it further includes at least one catch to retain the upper housing portion in the closed position which is releasable without the use of any tool.

When the upper housing portion is in the open position it may be the case that airflow paths within the head are accessible for cleaning or maintenance.

It is preferred if, the brush bar is selectively driven by a drive mechanism and when the upper housing portion is in, the open position, the drive mechanism is accessible for cleaning or maintenance. In such circumstances the brush bar is readily removable without the use of any tool.

The head may further include a switch for control of the drive mechanism which is open when the upper housing portion is in the open position, such that the drive mechanism cannot be operated, and closed when the upper housing portion is in the closed position, such that the drive mechanism can be operated. In such cases the switch may be activated by a protrusion on an inner surface of the upper housing portion which contacts the switch when the upper housing portion is moved to the closed position.

The drive mechanism may include an electric motor within the head.

As an alternative to including an electric motor, the drive mechanism may include a turbine within the head. In this case, the accessible air flow paths within the head, when the upper housing portion is moved to its open position, may include a path to and/or from the turbine, or possibly even through the turbine providing access to a rotor thereof in case it should require to be cleaned.

The drive mechanism for rotation of the tool element may include a drive belt having internal and external surfaces, and which does not pass around the tool element.

This feature of the invention provides the advantage that the tool element can be removed readily from the drive mechanism.

Preferably the drive mechanism further includes a drive pinion provided on the tool element, and the drive belt is toothed on its external surface and engages with the drive pinion.

The drive mechanism may further include a turbine which drives a turbine pinion engaging the belt. Alternatively it may include an electric motor which drives a motor pinion engaging the belt.

The drive belt may be toothed on its internal surface, and pass around and engage with the turbine or motor pinion. Alternatively the motor or turbine pinion may engage the toothed external surface of the drive belt.

As a possible alternative to the use of a toothed belt, a circumferential drive surface may be provided on the tool element which is engaged frictionally by the external surface of the belt. The drive surface on the tool element may be in the form of a pulley, e.g. of vee section, and the external surface of the belt have an appropriate corresponding cross-sectional shape to cooperate therewith.

Just as a motor or turbine may have a pinion which engages the toothed internal or external surface of the drive belt, the motor or turbine may have a drive wheel, e.g. a pulley which frictionally engages the internal or external surface of the drive belt.

Conveniently the drive mechanism further includes a support wheel around which the drive belt also passes, and which holds the drive belt adjacent to the tool element and in engagement with the drive pinion on the tool element.

The use of a drive belt which does not pass around the tool element enhances the ability of the tool element to be readily removed without the use of any tools or implements, which means that, in addition to the advantage of easy clearing of any entanglement from the tool element, a particular type of tool element may if required be replaced by an alternative type of tool element intended to perform a different function. For example a brush bar intended for use on a carpeted surface may be replaced by a different type of brush bar intended for use on a hard surface, or by a buffing or polishing tool for example. Hitherto the difficulty of removing the tool element has meant that suction cleaner heads have not generally been intended for use with different types of tool element.

Thus, there may be provided a plurality of tool elements, adapted to perform different functions, any one of which may be installed in the head as desired.

According to a second aspect of the present invention there is provided a suction cleaner including a head according to the first aspect of the invention.

According to a third aspect of the invention there is provided a cleaning apparatus adapted for use with a suction cleaner, the cleaning apparatus including:

a connector adapted to be removably connected to a wand of the suction cleaner;

a lower housing portion secured to the connector and having ground engaging wheels;

an upper housing portion secured to the connector, characterised in that the lower housing portion provides support for a rotatably mounted brush bar, and the upper housing portion is movable relative to the lower housing portion between a closed position and an open position in which the brush bar is exposed from above.

Embodiments of the invention will now be described, by way of example only, with reference to the accompanying drawings in which:

FIG. 1 is perspective view of an embodiment of a head for a suction cleaner according to the invention;

FIGS. 2*a* & 2*b* are side views of the head of FIG. 1, connected to the wand of a suction cleaner, and in (a) a first position and (b) a second position;

Figure 2A:
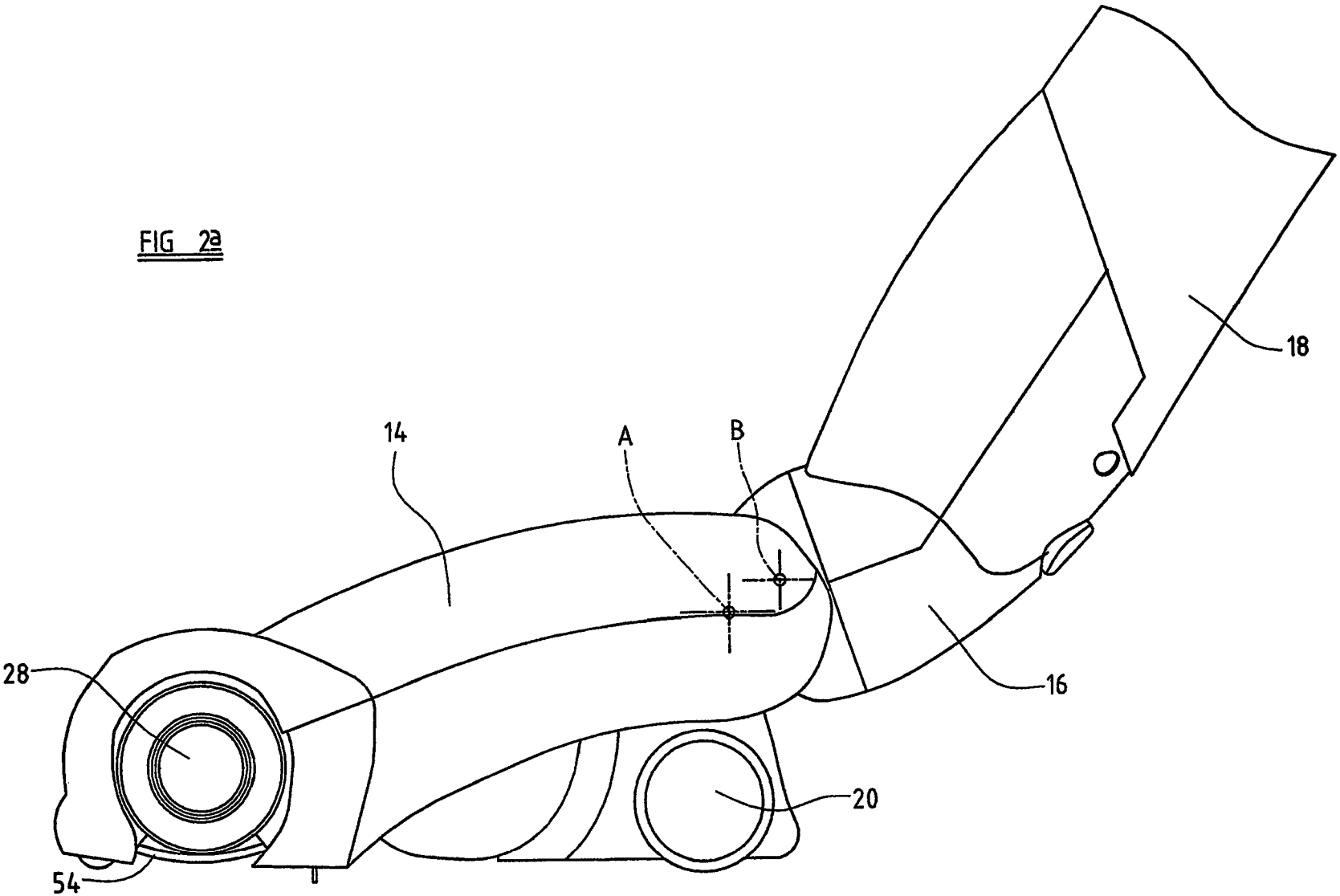
Figure 2B:
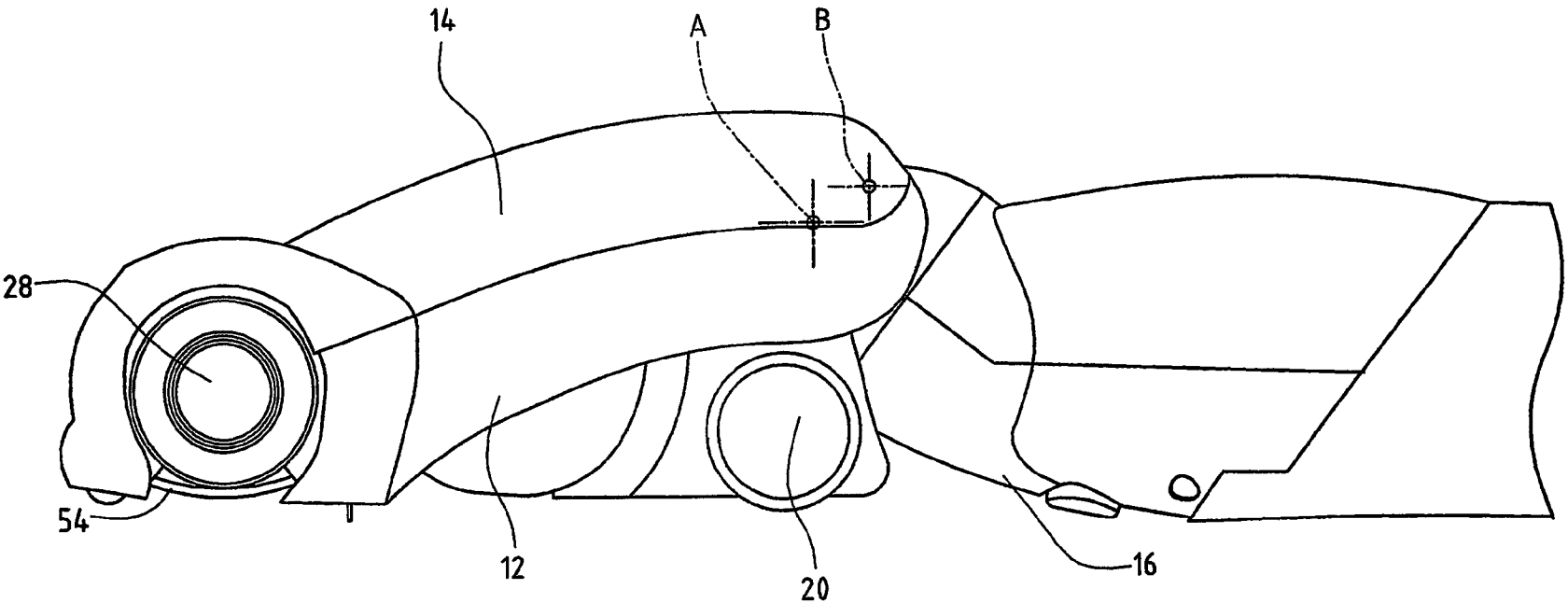
Figure 3:
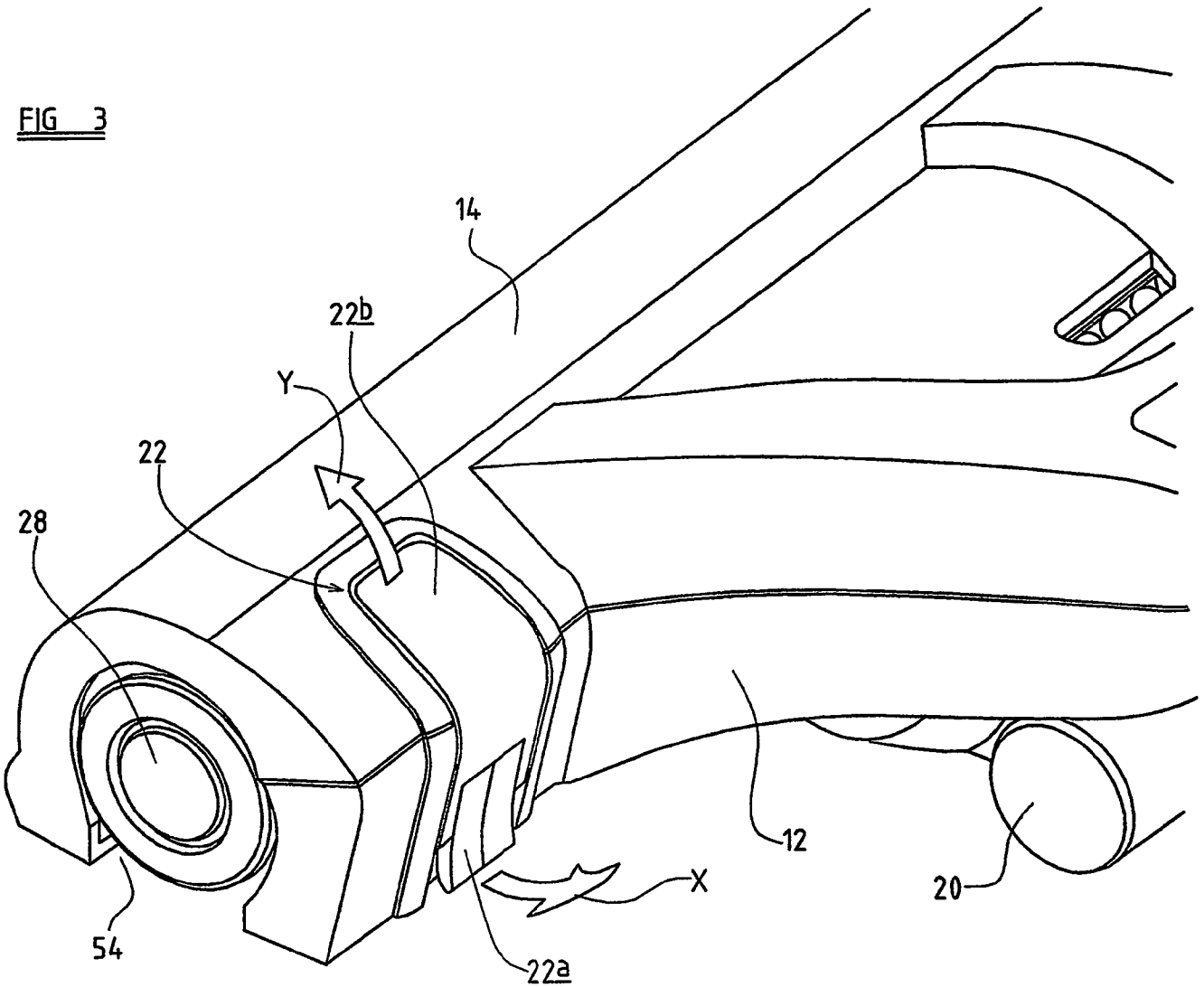
FIG. 3 is a rear perspective view of part of the head of FIG. 1, showing the catch in more detail.

Referring to the Figures, a head 10 comprises a lower housing portion 12, an upper housing portion 14 and a connector portion 16 for connection of the head 10 to a wand 18 of a suction cleaner (not shown). The connector portion 16 is pivotally secured to the lower housing portion 12, as best illustrated in FIGS. 2 and 3; FIG. 2 showing the general relationship between the components in normal use and FIG. 3 showing the general relationship between the components in storage or when reaching under furniture for example. The ability to reach the flat position shown in FIG. 2*b* is provided by the raised pivot axis A of the connector portion 16 relative to the lower housing portion 12 with respect to the ground.

Figure 1:
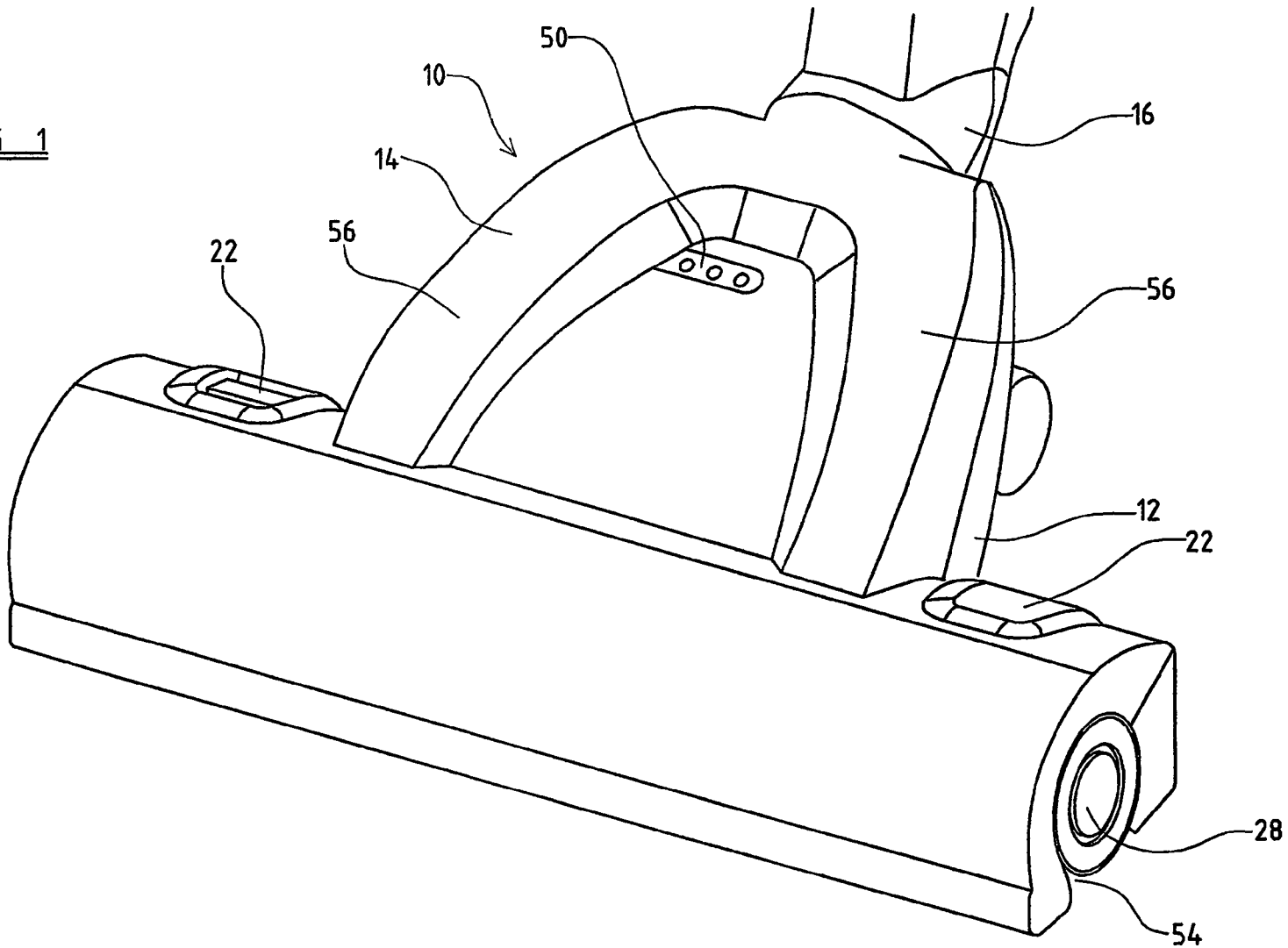
Figure 4:
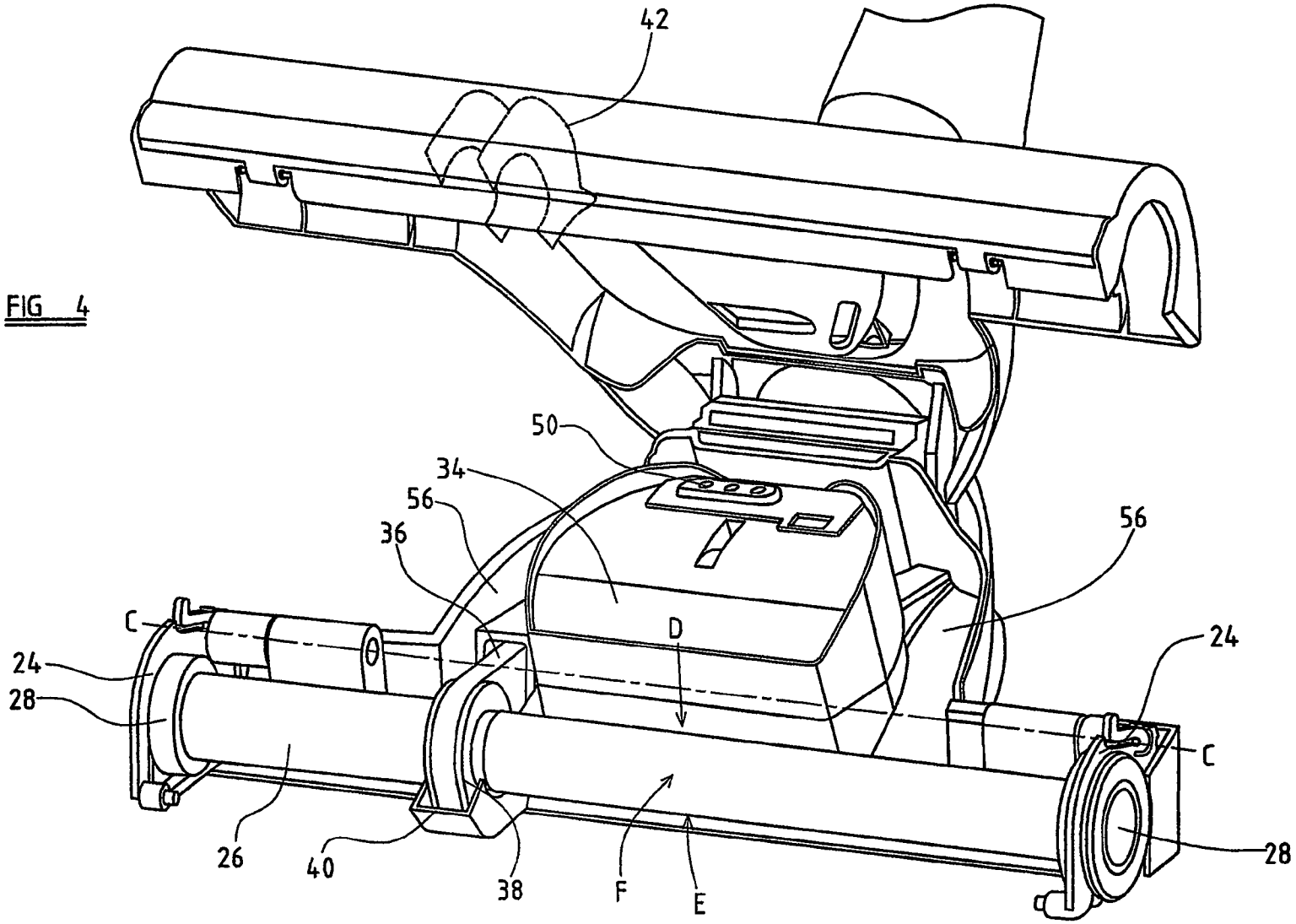
FIG. 4 is a perspective view of the head of FIG. 1 with the upper housing portion in its open position.
Figure 5:
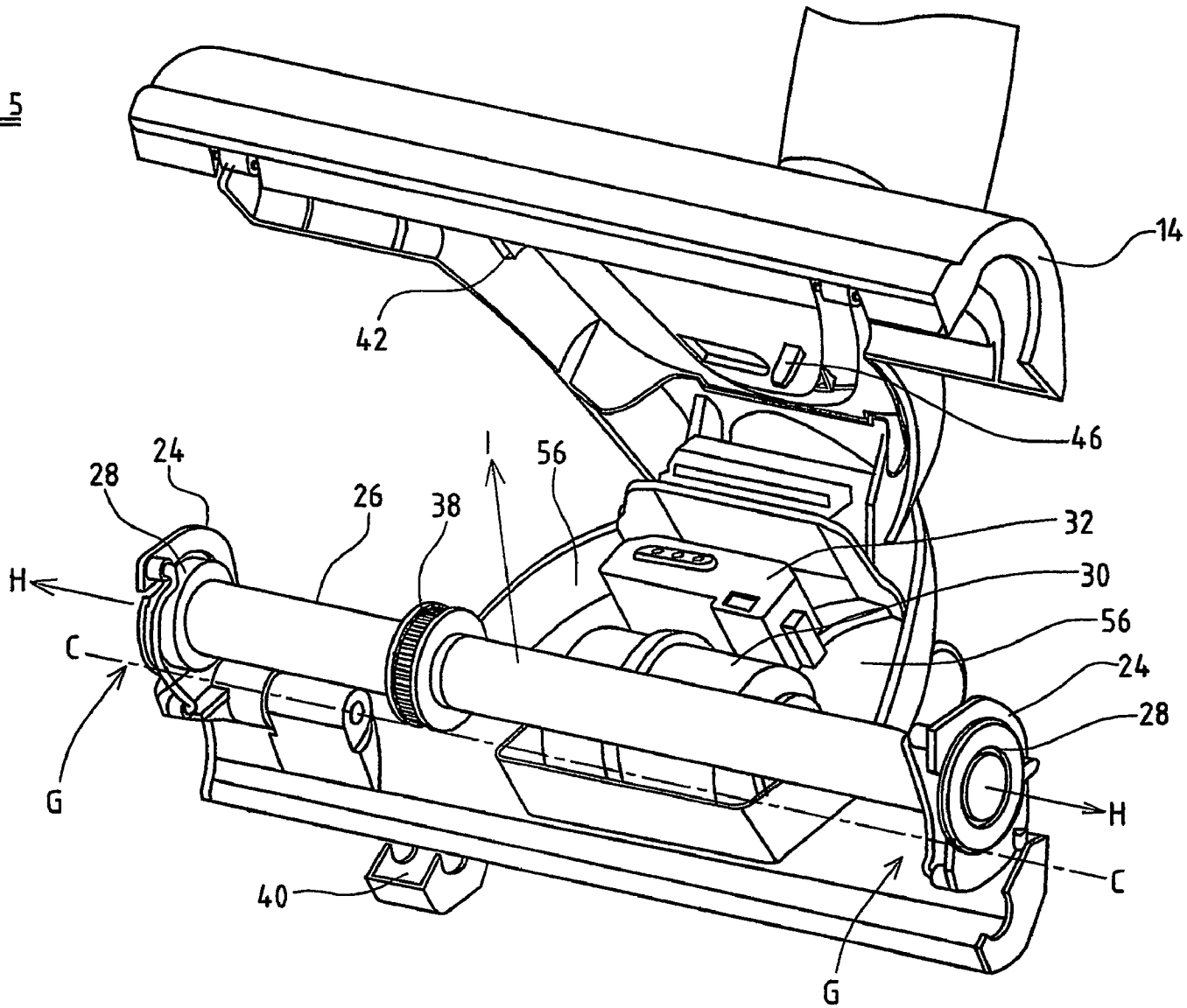
FIG. 5 is a perspective view of the head of FIG. 1 with the upper housing portion in its open position, and the brush bar in the process of being removed.
Figure 6:
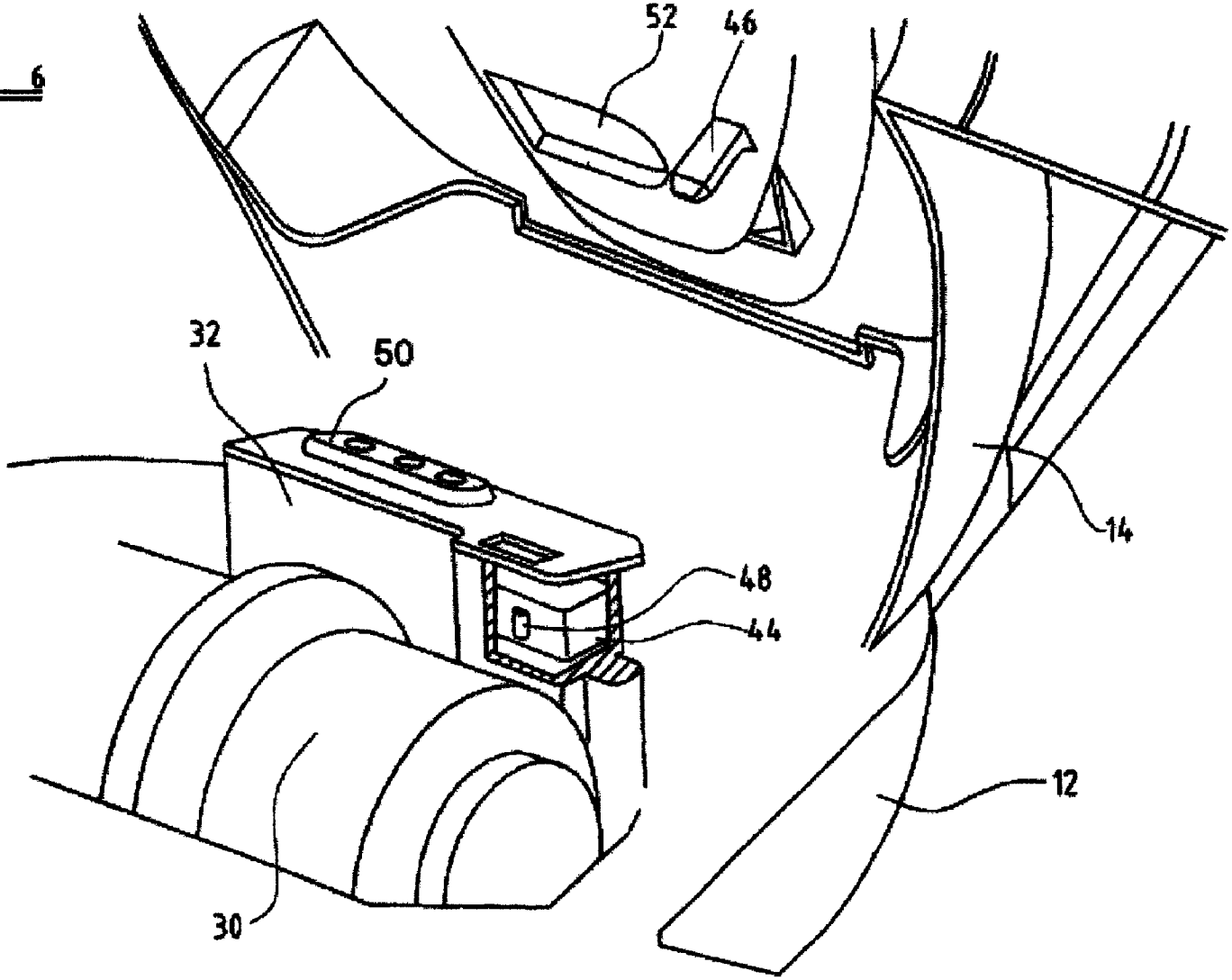
FIG. 6 is an enlarged perspective view of part of the head of FIG. 1 with the cover of the electric motor removed for clarity.

The upper housing portion 14 is pivotable about an axis B between a closed position shown in FIGS. 1 and 2 and an open position as shown in FIGS. 4 to 6. The upper housing portion of 14 is retained in the closed position by means of catches 22, located towards either side of the head 10. The catches 22 comprise a conventional form of over-centre mechanism, as shown in FIG. 3. They operate as follows: lower link 22*a* is released by pulling upwards as indicated by arrow X, the upper link 22*b* of the catch 22 then pivots up and forwards as indicated by arrow Y to release. The reverse is undertaken to resecure the catches 22. Thus it can be seen that the catches 22 can be released, and resecured, without the use of any tool.

The lower housing portion 12 provides ground engaging wheels 20 to either side towards the rear thereof. It also provides pivotally mounted brush bar retaining cradles 24 to either side towards the front thereof, for support of a brush bar 26. The brush bar retaining cradles 24 are pivotable about an axis C located rearwardly and above the location of the brush bar 26 in use. The brush bar 26 has on either end a removable end cap 28. The purpose of the pivotable brush bar retaining cradles 24 and removable end caps 28 will become apparent in due course when the removability of the brush bar 26 is described.

The brush bar 26 is selectively drivable by means of a drive mechanism which will now be described. The lower housing portion 12 provides support for an electric motor 30 and associated control unit 32, and motor cover 34 (shown in FIGS. 4 to 6). The motor 30 provides the drive for the brush bar 26 via a drive belt 36 which passes around the brush bar 26 at the location of drive wheel 38. The path of the drive belt 36 is enclosed within a cover comprising a first cover part 40 provided by the lower housing portion 12, and a second cover part 42 provided by the upper housing portion 14. The cover provided by the first and second cover parts 40, 42 means that the drive belt 36 is completely enclosed in use and thus protected from dirt and damage.

The control unit 32 for the motor 30 includes a switch 44 which is activated by a protrusion 46 provided on an inner surface of the upper housing portion 14. As the upper housing portion 14 is moved from its open position to its closed position the protrusion 46 operates external button 48 of the switch 44. The switch 44 is provided as a safety feature to ensure that the motor 30 cannot be operated to drive the brush bar 26 whilst the upper housing portion 14 is in its open position. Thus, the motor 30 can only be operated to drive the brush bar 26 when the protrusion 46 has operated the button 48 to close switch 44.

The control unit 32 further includes indicator lights 50, in this embodiment three of them, on its upper surface which can be viewed through an opening in motor cover 34, and an opening 52 in the upper housing portion 14. The indicator lights 50 can, for example, be used to indicate that (a) a supply of electricity is provided to the control unit 32, (b) the motor 30 is being operated such that the brush bar 26 is rotating, and (c) that the brush bar is not rotating, i.e. has been fouled by some debris. Conveniently the lights for (a) and (b) may be green LEDs and the light for (c) may be a red LED. Clearly the number of indicator lights provided and what they indicate may be varied as desired, for example they may indicate whether the brush bar is rotating at full speed or at a lower speed;

When the upper housing portion 14 is in its closed position it, in combination with the lower housing portion 12; defines an airflow opening 54, in which the brush bar 26 is located. The airflow opening 54 communicates with airflow passages 56 within the head 10 and positioned to either side of the motor 30 and control unit 32, and defined partly by the lower housing portion, 12 and partly by the upper housing portion 14. The airflow passages 56 combine to form a single airflow passage (not shown) where the upper and lower housing portions 12, 14 are secured to the connector portion 16. The use of two airflow passages 56 to connect the airflow opening 54 to the single airflow passage which passes up the wand 18 of the suction cleaner provides for more even suction across the width of the airflow opening 54.

The construction of the head 10 as described above provides the ability for simple removal of the brush bar 26 for, for example, cleaning or maintenance of the head 10. To remove the brush bar 26 the following steps are taken. The catches 22 are released and the upper housing portion 14 is pivoted upwardly about the axis B, to the position shown in FIG. 4. In that, position of the brush bar 26 is accessible from above, below and the front as indicated by arrows D, E and F in FIG. 4. This is particularly the case because the lower housing portion 12 does not include any part which extends laterally between its sides forward of the brush bar 26, and because the head 10 does not include any sole plate or the like.

The brush bar retaining cradles 24 are then gripped and pivoted upwardly and rearwardly about axis C as indicated by arrows G in FIG. 5. Next the end caps 28 are gripped and pulled outwardly as indicated by arrows H in FIG. 5, to remove them from the ends of the brush bar 26. The brush bar 26 can then be lifted upwards and out of the head 10 as indicated by arrow I in FIG. 5, with the appropriate lateral movement to remove the brush bar 26 from the drive belt 36.

As will be understood the brush bar 26 can be removed from the head 10 very simply and without the use of any tool. Furthermore, the brush bar 26 can be replaced within the head 10 by simply reversing the steps described above, and again without the use of any tool. Thus, the brush bar 26 can be cleaned and the airflow passages 56 cleared. As a result users of the suction cleaner concerned are much more likely to undertake such simple cleaning and maintenance than would be the case with prior art heads.

Figure 7:
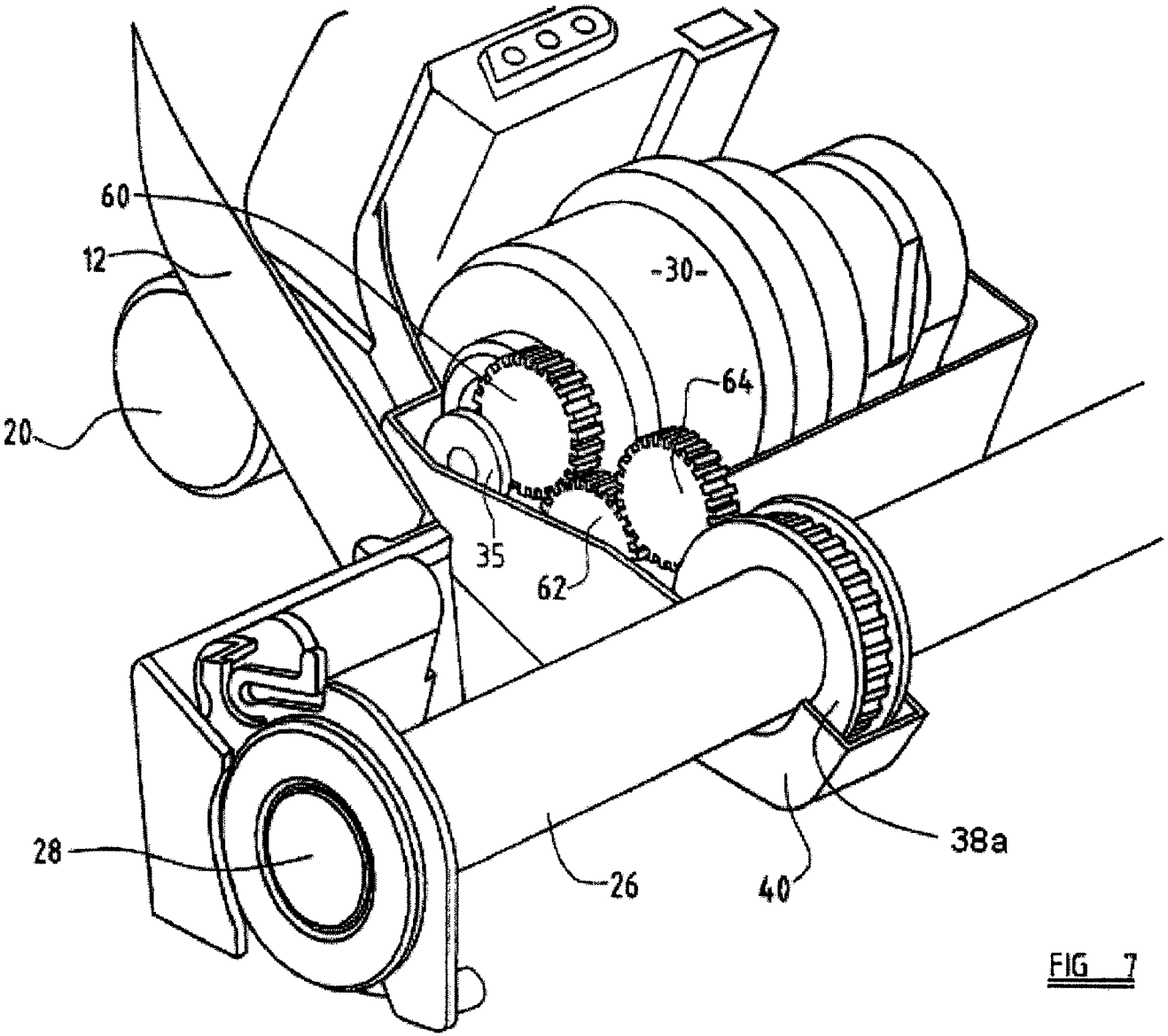
FIG. 7 is an enlarged perspective view of the drive for the brush bar of an alternative embodiment, again with the cover of the electric motor and of the drive belt removed.

Referring now in particular to FIG. 7, an alternative embodiment of the head, and in particular the drive mechanism for the brush bar is illustrated, with parts common to the previously described embodiment being like referenced, and will now be discussed. The drive mechanism includes a pinion 35 and a brush bar drive pinion 38*a*, but the drive belt 36 has been replaced by gears 60, 62 and 64. This embodiment still enables the brush bar 26 to be removed in the same simple way as described above, and no component passes around the brush bar 26.

Figure 8:
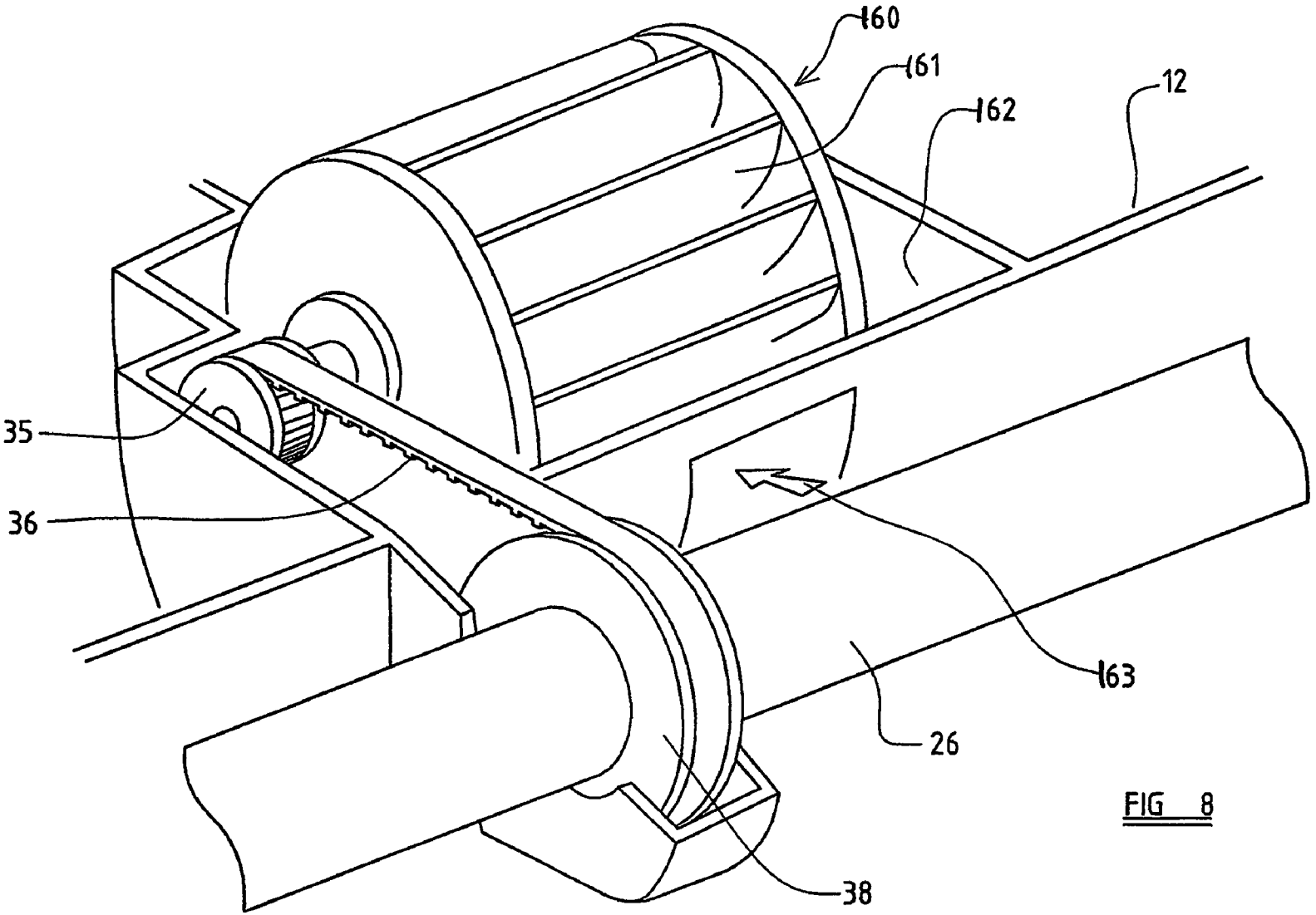
FIG. 8 is an enlarged perspective view of part of an alternative embodiment of head, including a turbine for driving the brush bar.

Referring now to FIG. 8, this shows part of a head in which instead of there being an electric motor for driving the brush bar there is a turbine. Only part of the lower housing portion 12 is shown, and this includes a part 162 which (together with a corresponding not illustrated part of housing portion 14) defines a chamber within which a turbine rotor 160 having blades 161 is rotatably supported. An air inlet to such chamber from the region of the brush bar 26 is indicated at 163, and an outlet (not shown) from the chamber leads to the connector portion 16 in the vicinity of where the airflow passages 56 join. Thus part of the suction airstream passes through the chamber, causing the rotor 160 to rotate. The rotor shaft carries a pinion 35 connected by a toothed drive belt 36 to a drive wheel 38 on the brush bar 26.

If as shown in FIG. 8 the pivoting of the upper housing portion 14 to its open position relative to the lower housing portion 12 exposes the turbine rotor 160 within its chamber, and the passages for flow of air to and from the chamber, cleaning of the rotor and/or the removal of any debris from the vicinity thereof which might impede its operation is facilitated. However, such cleaning of a turbine is likely to be required much less frequently than is attention to the brush bar, and hence in an alternative arrangement of a turbine the turbine may operate within a chamber defined by a part or parts which remain in place when the upper housing portion is moved to the open position. The use of tools may be required to gain access to the interior of the turbine and/or the associated air flow passages.

The invention has only been described in use with a selectively driven brush bar, however, it is equally applicable to any other kind of head for such cleaners. For examples heads with a rotatable but not driven brush bar, and heads without a brush bar but including fixed lines of bristles or a rubber blade.

Figure 9:
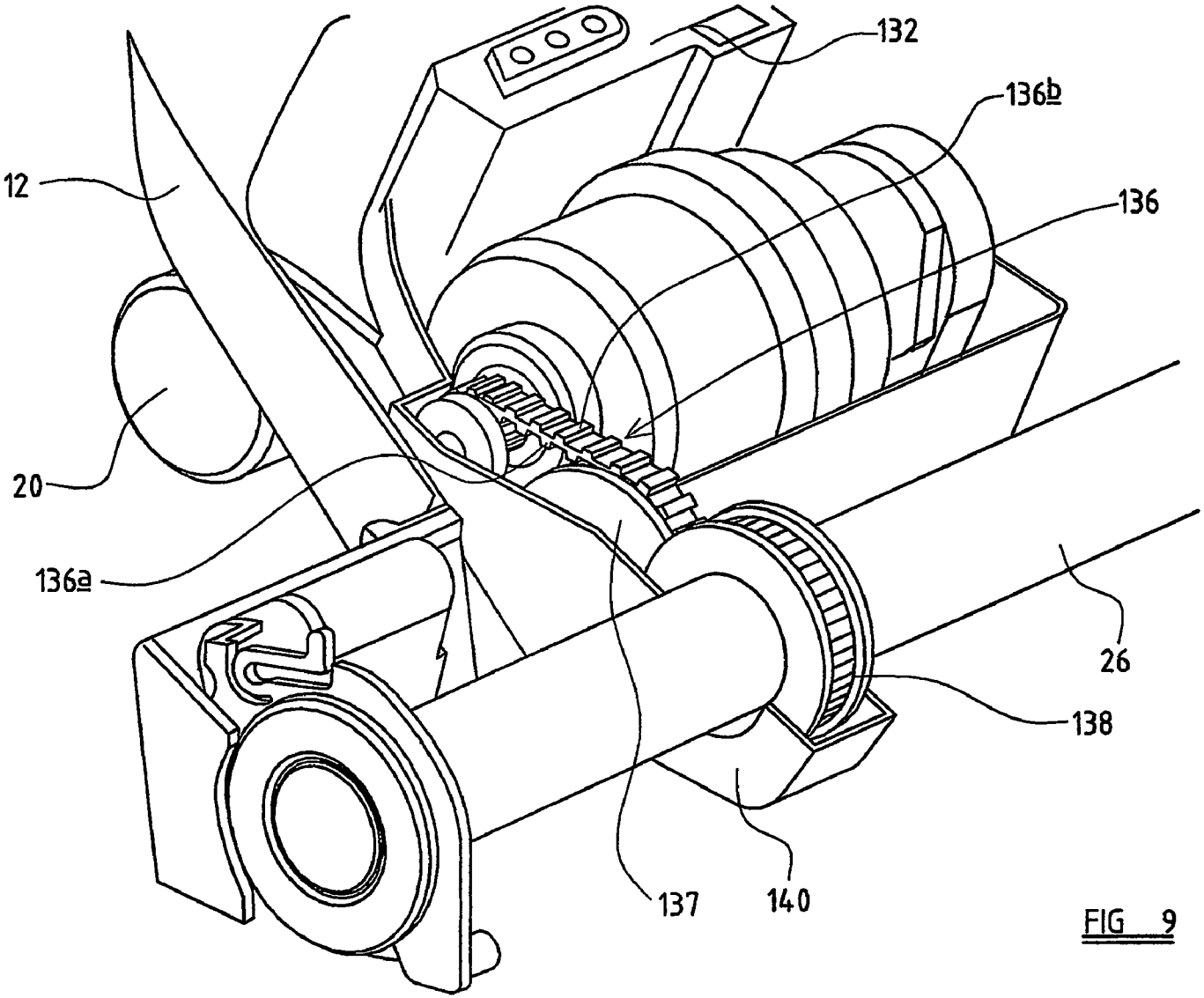
FIG. 9 is an enlarged perspective view of an alternative drive mechanism for the brush bar of the preceding Figures, with the cover of the electric motor and of the drive belt removed.

Referring now to FIG. 9 of the drawings, an alternative brush bar drive mechanism will now be described. The lower housing portion 12 provides support for an electric motor 130 and associated control unit 132, and motor cover as 34 (shown in FIGS. 5 to 8). The motor 130 provides the drive for the brush bar 26 via pinion 135, and a drive belt 136 which is toothed on both internal and external outside surfaces 136*a* and 136*b* and which also passes around support wheel 137 (which may or may not be toothed). The drive belt 136 engages with drive pinion 138 located on the brush bar 26, by means of its toothed external surface 136*b*. Thus the drive of the brush bar 26 is achieved without the need for the drive belt 136 to pass around the brush bar 26.

The path of the drive belt 136 is enclosed within a cover comprising a first cover part 140 provided by the lower housing portion 12, and a second cover part (not shown) provided by the upper housing portion 14. The cover provided by the first and second cover parts means that the drive belt 136 is completely enclosed in use and thus protected from dirt and damage.

If it is required to remove/replace the brush bar 26 in the embodiment of FIG. 9, it is done essentially as described above in relation to the previous embodiment, being yet further assisted by the fact that the drive belt 136 does not pass around the brush bar 26, and hence does not have to be disengaged therefrom and engaged therewith.

Tool elements provided with the head 10 may take the form of different kinds of brush bar specifically adapted for different floor surfaces with different bristle densities and/or hardnesses, and other forms such as buffing bars for buffing and polishing of hard floors with the bristles replaced by pads.

Figure 10:
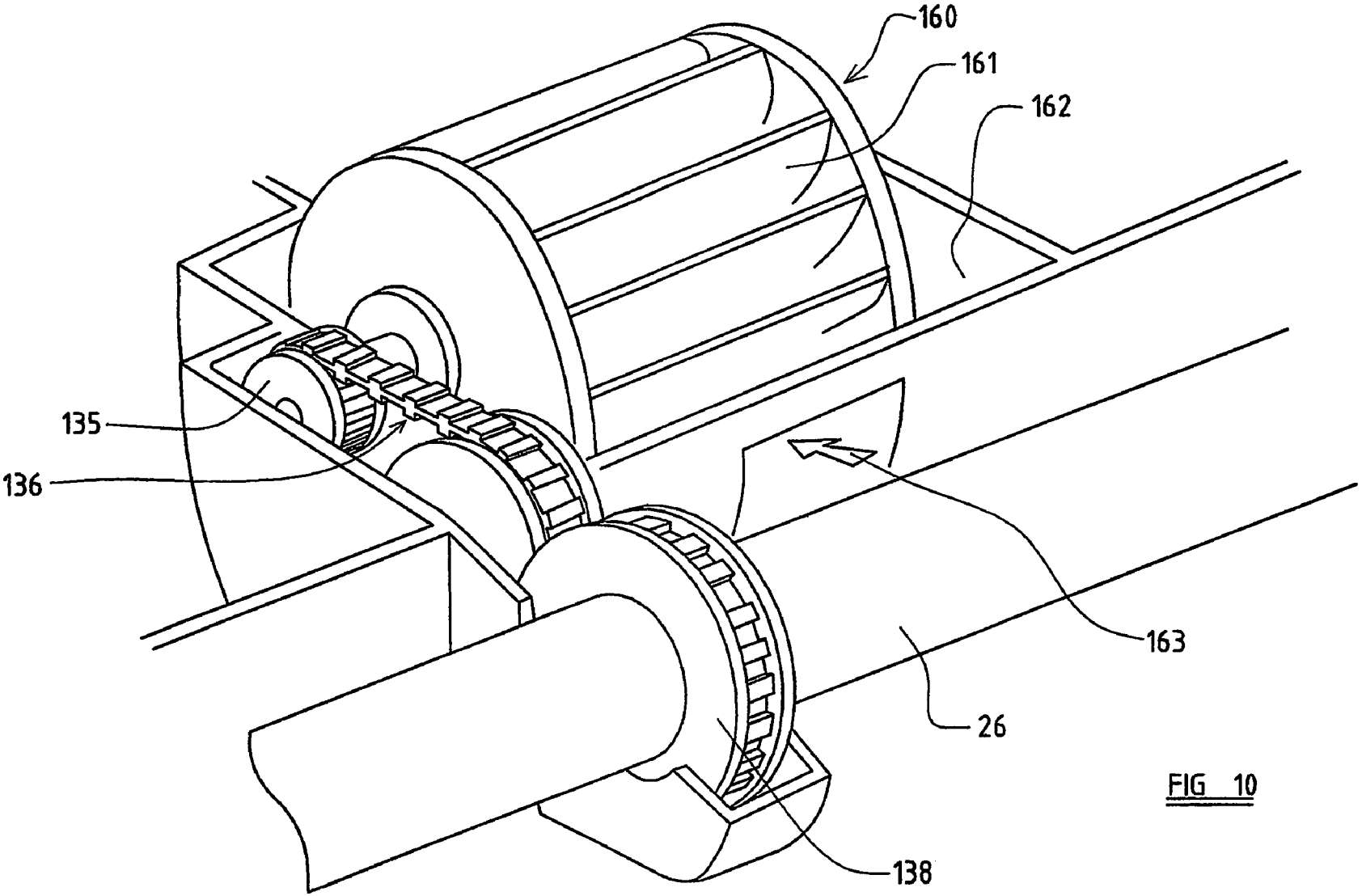
FIG. 10 is a view corresponding to FIG. 9, but of a modified drive mechanism.

FIG. 10 illustrates, in a view corresponding to part of FIG. 9, a similar drive arrangement to that of FIG. 9 but in a "turbo" head. The difference is that instead of the electric motor 130 there is a turbine rotor 160 having blades 161, carried by a rotatably-supported shaft having pinion 135 at its end. The rotor 160 is disposed within a housing part 162 of the lower housing portion 12 and a corresponding part (not shown) of the upper housing portion 14 together affording a chamber accommodating the rotor. An air inlet to such chamber from the region of the brush bar 26 is indicated at 163, and an outlet (not shown) from the chamber leads to the connector portion 16 in the vicinity of where the air flow passages 56 join. Thus part of the suction airstream passes through the chamber causing the rotor 160 to revolve and drive the belt 136, possibly by way of a suitable reduction gearing.

When the upper housing portion 14 is pivoted to its open position relative to the lower housing portion 12, it may give access as illustrated to the turbine rotor 160 within its chamber, and the passages for airflow to and from the chamber, to facilitate cleaning of these parts if it is required. However, such cleaning of the turbine is likely to be necessary much less frequently than is cleaning of the brush bar, and thus the pivotal opening of the housing portion 14 need not give access to the turbine interior. The turbine may in this case be a unit at least partly having its own housing, disposed within the housing 12, 14 of the head 10.

Figure 11:
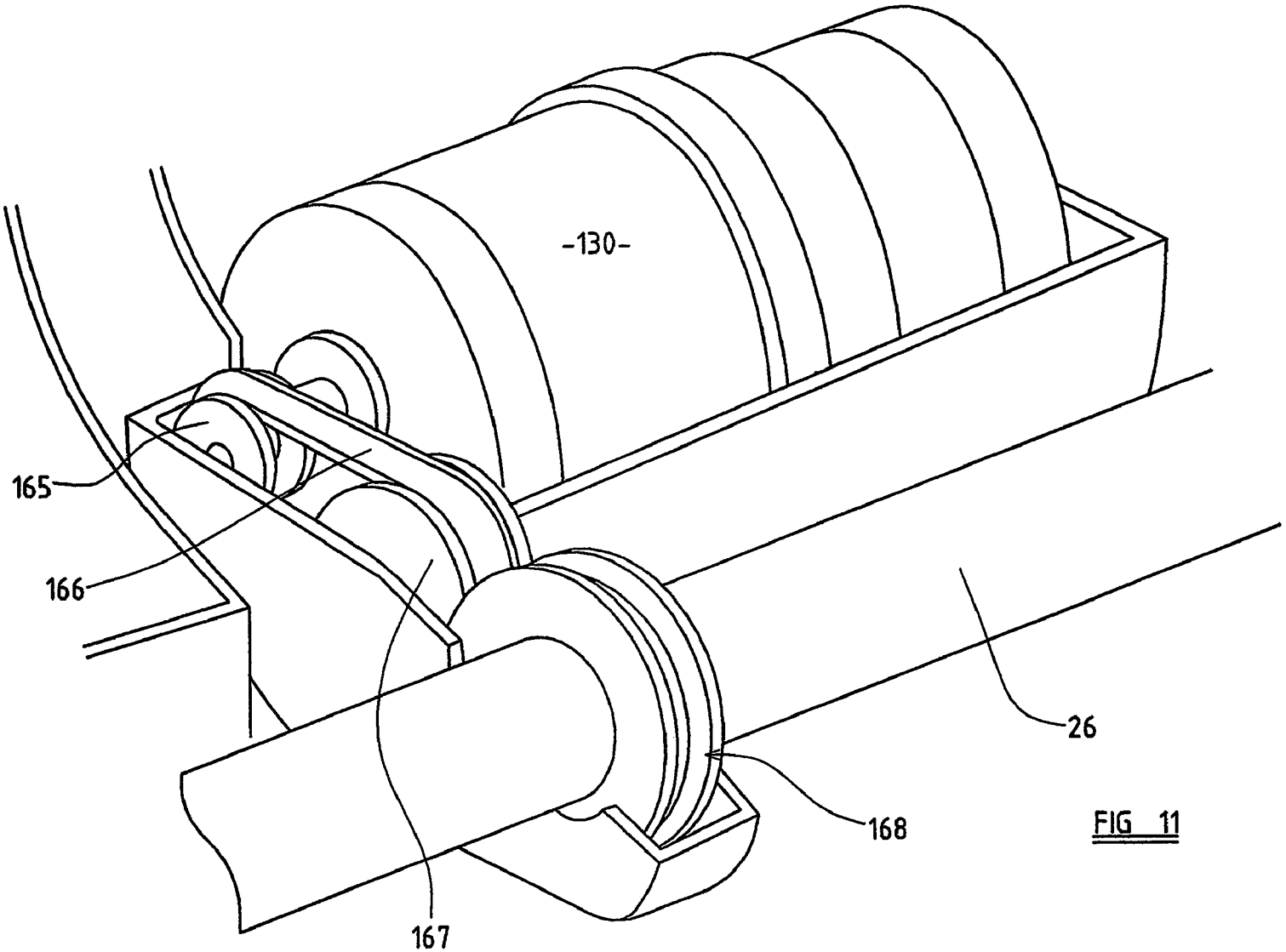
FIG. 11 is a view as FIG. 10, showing yet a further modification of drive mechanism.

Referring now to FIG. 11 of the drawings, this shows a further embodiment with an electric motor 130 whose shaft is provided with a pulley 165 instead of the pinion 135. A belt 166 is entrained around the pulley 165 and a support wheel 167 which is also in the form of a pulley rather than the pinion 137. The cross-sectional shape of the interior surface of belt 166 which engages the pulley 165 and support wheel 167 may be of "Vee-belt" form and the pulley and support wheel may be correspondingly shaped to be engaged by the belt. The brush bar 26 has a drive surface 168 which is engaged by the external surface of the belt to be driven frictionally thereby. The cross-sectional shape of the drive surface part 168 on the brush bar, and of the external surface of the belt 166 may be that of a vee pulley and belt respectively, or any other suitable profile for frictional driving, e.g. part-circular or possibly even flat.

Figure 12:
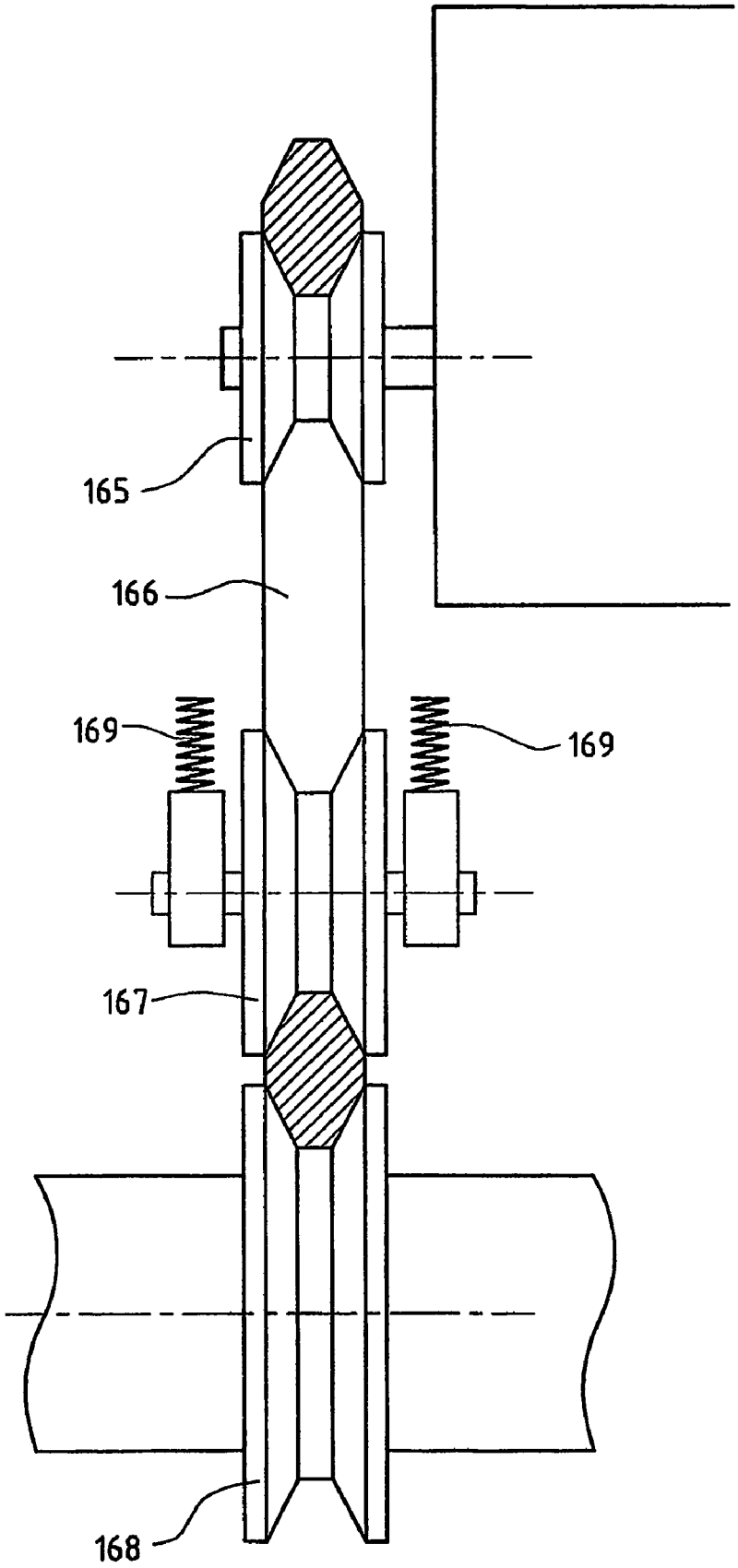
FIG. 12 is a plan view of part of the mechanism shown in FIG. 11.

FIG. 12 shows diagrammatically, in a partly sectioned view, the arrangement of the pulley 165, belt 166, support wheel 167, and brush bar drive wheel part 168 of FIG. 9. The support wheel 167 is shown to be biased by springs 169 away from the pulley 165, to maintain tension in the belt between the pulley 165 and support wheel 167 and to establish good frictional driving conditions with the drive surface of the brush bar. The belt 166 is shown as having a vee profile on both its internal and external surfaces.

Figure 13:
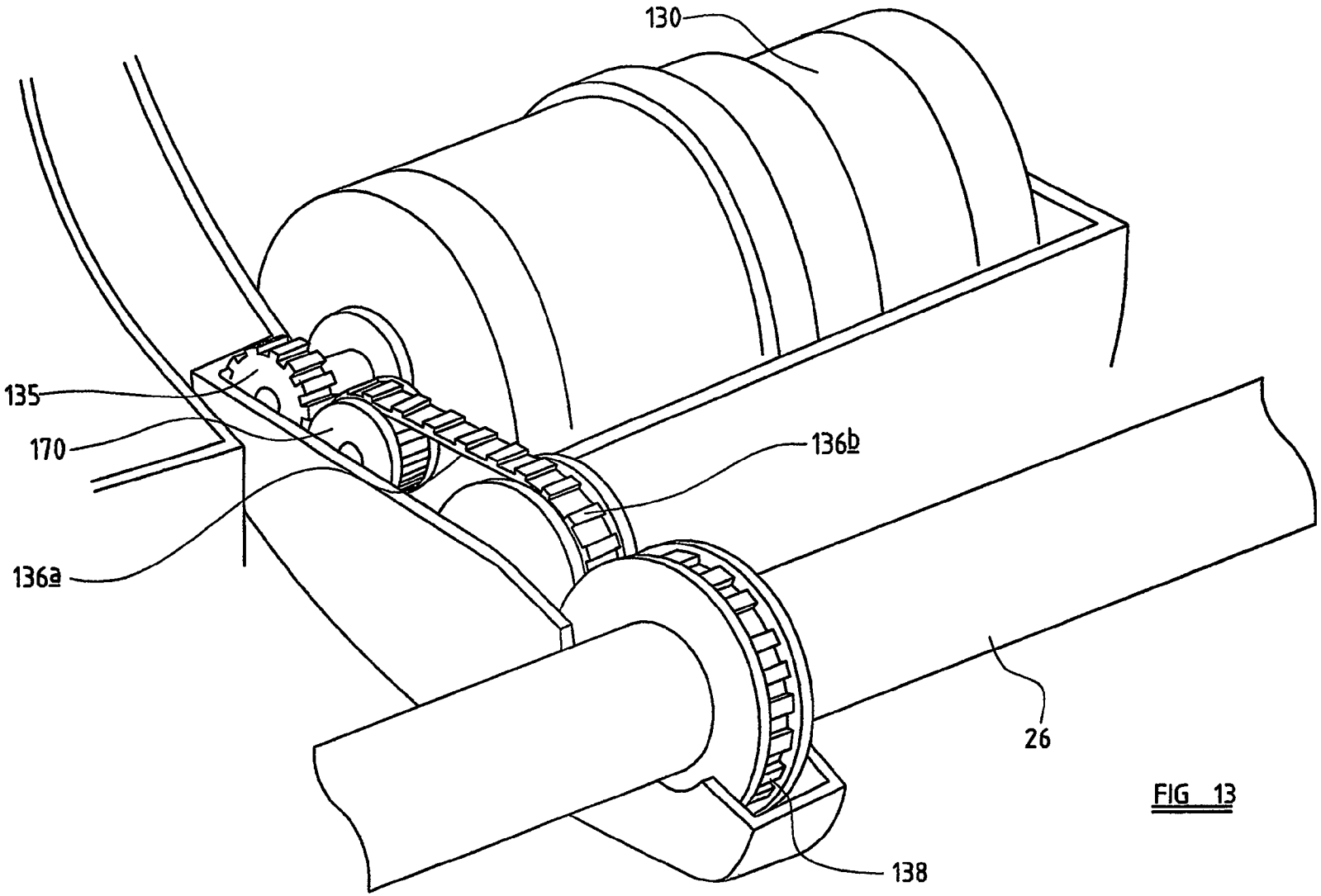
FIG. 13 is a view as FIGS. 10 and 11, showing yet a further modification of the drive mechanism.

Referring finally now to FIG. 13, this shows an embodiment wherein the drive belt 136 is provided with teeth at **136*b* on its external surface, but its internal surface 136*a* is not toothed. Instead of extending around the pinion 135 driven by an electric motor 130 (or by a turbine), the belt extends around a further support wheel 170 positioned adjacent the pinion 135 and the pinion engages the toothed external surface 136*b* of the belt. The belt engages the brush bar pinion 138** as above described. This arrangement of a drive mechanism, using a belt toothed on one only of its surfaces, may be valuable in certain arrangements of brush bar and motor in the head.

It would further alternatively be possible for a pulley on the drive shaft of a motor or turbine to engage the external surface of a drive belt of suitable cross-sectional shape, for example as shown: in FIGS. 10 and 12, frictionally to drive the belt.

Although the invention has been described in connection with the head of a cylinder type suction cleaner which is secured for use to a wand of the cleaner, it is equally applicable to the heads of upright type suction cleaners.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A head for a suction cleaner, the head comprising:

a. a lower housing portion;

b. an upper housing portion movable relative to the lower housing portion between a closed position for use and an open position in which airflow passages within the head are opened from above, wherein the head is provided with at least one catch to retain the upper housing portion in the closed position and releasable to move the upper housing portion into the open position; and c. a rotatably mounted tool element which is entirely exposed from above and in front of the tool element and readily removable when the upper housing portion is in the open position, wherein the tool element is directly driven by a drive mechanism comprising a drive belt having internal and external surfaces, wherein the drive belt does not pass around the tool element and the external surface directly engages the tool element, and wherein no portion of the drive mechanism is positioned directly above the tool element such that the tool element is readily removable in an upward direction through the open upper housing portion without necessitating movement of the drive mechanism.

2. A head for a suction cleaner according to claim 1 wherein the head does not include a sole plate.

3. A head for a suction cleaner of claim 1 wherein when the upper housing portion is in the closed position it defines, in combination with the lower housing portion, an airflow opening which in use is adjacent the ground.

4. A head for a suction cleaner according to claim 3 wherein the tool element is located within the airflow opening.

5. A head for a suction cleaner according to claim 1 wherein when the upper housing portion is in the open position airflow paths within the head are accessible for cleaning or maintenance.

6. A head for a suction cleaner according to claim 1 wherein the drive mechanism is accessible for cleaning or maintenance when the upper housing portion is in the open position.

7. A head for a suction cleaner according to claim 1 wherein the tool element is readily removable without the use of any tool.

8. A head for a suction cleaner according to claim 6 further comprising a switch for control of the drive mechanism which is open when the upper housing portion is in the open position, such that the drive mechanism cannot be operated, and closed when the upper housing portion is in the closed position, such that the drive mechanism can be operated.

9. A head for a suction cleaner according to claim 8 wherein the switch is activated by a protrusion on an inner surface of the upper housing portion which contacts the switch when the upper housing portion is moved to the closed position.

10. A head for a suction cleaner according to claim 6 wherein the drive mechanism includes an electric motor within the head.

11. A head for a suction cleaner according to claim 6 wherein the drive mechanism includes a turbine within the head and wherein said airflow paths include a path connecting the turbine.

12. A head for a suction cleaner according to claim 1 wherein the drive mechanism further includes a drive pinion provided on the tool element, and the drive belt is toothed on its external surface and engages with the drive pinion.

13. A head for a suction cleaner according to claim 1 wherein a circumferential drive surface is provided on the tool element and the external surface of the belt frictionally engages the drive surface.

14. A head for a suction cleaner according to claim 13 wherein the drive surface is a pulley and the external surface of the belt has a cross-section which cooperates with the pulley.

15. A head for a suction cleaner according to claim 1 wherein the drive mechanism further includes an electric motor or a turbine that drives a pinion engaging the drive belt, wherein the pinion is connected to and extends axially from the motor or turbine.

16. A head for a suction cleaner according to claim 15 wherein the drive belt is toothed on its internal surface, passes around, and engages with the pinion.

17. A head for a suction cleaner according to claim 15 wherein the pinion engages a toothed external surface of the drive belt.

18. A head for a suction cleaner according to claim 13 wherein the drive mechanism further includes a motor or turbine having a drive wheel which frictionally engages the drive belt.

19. A head for a suction cleaner according to claim 1 wherein the drive mechanism further includes a support wheel around which the drive belt also passes, and which holds the drive belt adjacent to and in engagement with the tool element.

20. A head for a suction cleaner according to claim 19 wherein the support wheel is freely rotatable.

21. A head for a suction cleaner according to claim 19 wherein the support wheel is a pinion.

22. A head for a suction cleaner, the head comprising:

a lower housing portion;

an upper housing portion movable relative to the lower housing portion between a closed position for use and an open position in which airflow passages within the head are opened from above;

a rotatably mounted tool element which is entirely exposed and removable from above and in front when the upper housing portion is in the open position; and a drive mechanism that includes a drive belt comprising an internal and an external surface wherein the drive belt does not pass around the tool element, and the tool element is directly driven by the external surface of the drive belt, wherein the drive belt defines a loop and the brush bar is positioned outside of and adjacent to the loop such that no portion of the drive mechanism is positioned directly above the brush bar such that the brush bar may be removed from above and in front of the drive belt without necessitating movement of the drive mechanism.

23. A head for a suction cleaner according to claim 22 further comprising a pinion that drives a toothed external surface of the drive belt, wherein the drive belt does not pass around the pinion.

24. A head for a suction cleaner according to claim 23 wherein the pinion is driven by an electric motor or turbine.

* * * * *